US006753095B1

(12) United States Patent
Shindou et al.

(10) Patent No.: US 6,753,095 B1
(45) Date of Patent: Jun. 22, 2004

(54) ZINC-BASED METAL PLATED STEEL SHEET TREATED WITH PHOSPHATE BEING EXCELLENT IN FORMABILITY AND METHOD FOR PRODUCTION THEREOF

(75) Inventors: Hidetoshi Shindou, Hyogo (JP); Kiyokazu Isizuka, Hyogo (JP); Keiichi Sanada, Hyogo (JP); Kazuo Takahashi, Hyogo (JP); Teruaki Yamada, Hyogo (JP); Daisuke Ito, Hyogo (JP); Shigekazu Ooba, Osaka (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 10/049,231

(22) PCT Filed: Aug. 8, 2000

(86) PCT No.: PCT/JP00/05301

§ 371 (c)(1),
(2), (4) Date: Feb. 11, 2002

(87) PCT Pub. No.: WO01/11110

PCT Pub. Date: Feb. 15, 2001

(30) Foreign Application Priority Data

Aug. 9, 1999 (JP) ..... 11-225454
Aug. 17, 1999 (JP) ..... 11-230198

(51) Int. Cl.[7] ..... B32B 15/04; B32B 15/18; C23C 22/07

(52) U.S. Cl. ..... 428/632; 148/246; 148/253; 148/255; 148/261; 148/262; 148/273; 148/276; 428/624; 428/628; 428/659; 428/687; 428/472.3

(58) Field of Search ..... 428/632, 624, 428/628, 659, 687, 472.3; 148/246, 253, 255, 261, 262, 273, 276

(56) References Cited

U.S. PATENT DOCUMENTS 6,322,906 B1 * 11/2001 Nakakoji et al. ..... 428/659
6,555,249 B1 * 4/2003 Hamahara et al. ..... 428/632

FOREIGN PATENT DOCUMENTS

| | | | |
|---|---|---|---|
| EP | 0653502 A2 * | 5/1995 | ..... C23C/22/73 |
| JP | 50-154129 | 12/1975 | |
| JP | 56-133488 | 10/1981 | |
| JP | 2-173274 | 7/1990 | |
| JP | 7-138764 | 5/1995 | |
| JP | 11-181577 | 7/1999 | |

* cited by examiner

*Primary Examiner*—Robert R. Koehler
(74) *Attorney, Agent, or Firm*—Wenderoth, Lind & Ponack, L.L.P.

(57) ABSTRACT

The aim of the present invention is to provide a phosphate treated zinc coated steel sheet with excellent workability. A steel sheet coated with a zinc based alloy has a phosphate treated coating on the surface thereof. The phosphate treated coating comprises mainly granulated crystals, specifically, crystals in which the average ratio of the major axis to the minor axis is not less than 1.00 and not more than 2.90. Moreover, the method for producing the phosphate treated coating uses a phosphate treatment solution in which the amount of Mg ions is ≧6 g/l and the amount of Zn ions is ≧0.5 g/l, or a phosphate treatment solution in which the amount of Mg ions is ≧10 g/l, the amount of Zn ions is 0≦ and <0.5 g/l, and the amount of nitric acid ions is ≧40 g/l. Moreover, the phosphate treated zinc coated steel sheet also has excellent corrosion resistance as the amount of Mg in the phosphate treated coating is not less than 10 mg/m$^2$, and has excellent weldability as the coating amount is controlled to 0.5 to 3.0 g/m$^2$.

16 Claims, 5 Drawing Sheets

ZINC-BASED METAL PLATED STEEL SHEET TREATED WITH PHOSPHATE BEING EXCELLENT IN FORMABILITY AND METHOD FOR PRODUCTION THEREOF

FIELD OF THE INVENTION

The present invention relates to a phosphate treated zinc coated steel sheet having excellent workability applied for use in vehicles, household appliances, building materials, and the like.

BACKGROUND ART

Conventionally, it is common for zinc coated steel sheet applied for use in vehicles, household appliances, building materials, and the like to undergo a phosphate treatment, a chromate treatment, and a further organic coating treatment so that the added value such as corrosion resistance, workability, and the like is improved. Recent years have seen a trend in which, because of environmental concerns, chromate treated steel sheet, in particular, is out of favor due to the possibility of hexavalent chromium being contained therein, and the demands on phosphate treatment have increased. Moreover, from the viewpoint of workability, because Zn—Ni based alloy plated steel sheet exhibits excellent properties, it is widely used, however, the drawback arises that, because the alloy plating includes Ni, the production costs are high. Therefore, attempts have been made to improve the added value by carrying out a phosphate treatment on electrically zinc coated steel sheet, hot-dip zinc coated steel sheet, and alloyed hot-dip zinc coated steel sheet, which each have low production costs.

However, in the conventional phosphate treatment for electrically zinc coated steel sheet, hot-dip zinc coated steel sheet, and alloyed hot-dip zinc coated steel sheet, a sufficient workability is not necessarily obtained as compared with Zn—Ni based alloy plated steel sheet. In particular, the workability is not sufficient when it is used in the performing of a drawing process in which the amount of inflow of steel sheet is regulated using a bead press whose use has increased in recent years.

In contrast to this, Japanese Patent Laid-Open Publication No. Hei 7-138764 discloses a zinc phosphate treated zinc coated steel sheet that contains at least one of Fe, Co, Ni, Ca, Mg, Mn, and the like and has excellent press performance. However, in this technology as well, sufficient performance is not obtained in the above bead press drawing process.

DISCLOSURE OF THE INVENTION

An object of the present invention is to solve the above problems and provide a phosphate treated zinc coated steel sheet having excellent workability. A further object is to provide a phosphate treated zinc coated steel sheet having excellent corrosion resistance and weldability.

As a result of their investigations into improving the workability of phosphate treated zinc coated steel sheet, the present inventors noticed that the shape of the surface phosphate crystals plays an extremely important role and thus achieved the present invention. Namely, the present invention provides a great improvement in the workability of the drawing in the bead press process by having a shape in which granulated crystals are mainly used.

The present invention also provided improved corrosion resistance by simultaneously supplying magnesium which has excellent corrosion resistance to the phosphate treatment coat. Moreover, by controlling the amount of the coating, it is also possible to improve the weldability.

Namely, the present invention is as follows.

(1) A phosphate treated zinc coated steel sheet with excellent workability, having a phosphate treated coating comprising mainly granulated crystals on a surface of azinc coated steel sheet.

(2) A phosphate treated zinc coated steel sheet with excellent workability, having a phosphate treated coating on a surface of a zinc coated steel sheet in which an average ratio of a major axis to a minor axis of crystals in the phosphate treated coating is not less than 1.00 and not more than 2.90. In this case, the average ratio is an average value of that crystal whose length ratio of the major axis to the minor axis is closest to 1.00 and that crystal whose length ratio of the major axis to the minor axis is the largest from among crystals seen when an SEM photograph (at a magnification of 5000×) is taken.

(3) A phosphate treated zinc coated steel sheet also with excellent corrosion resistance, wherein Mg is contained in the phosphate treated coating according to the above (1) or (2) in an amount of not less than 10 $mg/m^2$.

(4) A phosphate treated zinc coated steel sheet also with excellent weldability, wherein an adhered amount of the phosphate treated coating according to any one of the above (1) to (3) is from 0.5 $g/m^2$ to 3.0 $g/m^2$.

(5) A phosphate treated zinc coated steel sheet also with excellent intermediate rust prevention property, wherein a rust prevention oil layer is provided on the phosphate treated coating according to any one of the above (1) to (4).

(6) A method for producing a phosphate treated zinc coated steel sheet with excellent workability and corrosion resistance, wherein a phosphate treatment is performed on a zinc coated steel sheet using a phosphate treatment solution in which, among metallic ions included in the phosphate treatment solution, an amount of Mg ions is at least 6 g/l and an amount of Zn ions is at least 0.5 g/l.

(7) A method for producing a phosphate treated zinc coated steel sheet with excellent workability and corrosion resistance, wherein a phosphate treatment is performed on a zinc coated steel sheet using a phosphate treatment solution in which, among metallic ions included in the phosphate treatment solution, an amount of Mg ions is at least 6 g/l and an amount of Zn ions is 0 or more and less than 0.5 g/l, and an amount of nitric acid ions included in the phosphate treatment solution is at least 40 g/l.

(8) A method for producing a phosphate treated zinc coated steel sheet with excellent workability and corrosion resistance, wherein, after the phosphate treatment according to the above (6) or (7), a heavy magnesium phosphate coating is formed on a surface thereof by coating and drying in a coating amount of not more than 0.5 $g/m^2$.

(9) A phosphate treated zinc coated steel sheet with excellent workability, having a phosphate treated coating on a surface of a zinc coated steel sheet, the phosphate treated coating being characterized in that when measuring an X-ray diffraction pattern using CuKα ray characteristic X-rays, the strength ratio (Ia/Ib) of the largest strength value of the maximum peak (Ia) at which 2θ=not less than 9.540° and not more than 9.800° and the largest strength value of the maximum peak (Ib) at which 2θ=not less than 19.200° and not more than 19.660° is not less than 3.0.

There is no particular limitation on the zinc coated steel sheet used in the present invention, and an excellent workability improvement effect can be obtained when both pure zinc coating and alloy coating are used. However, in view of production costs, electrical zinc coating, hot-dip zinc coating, alloyed hot-dip zinc coating, and the like are preferable.

Other than as to the shape of the crystals of the phosphate coating formed on top of the zinc coating, there is no particular limitation, and generally examples thereof may include a zinc phosphate coating forming what are known as hopeit crystals, a zinc phosphate coating modified by an element such as Fe, Ni, Co, Mn, Mg, Ca, Cu, and the like, and complex phosphate treated coatings in which a post treatment is performed on the above zinc phosphate coatings.

As is shown in FIG. 1, the conventional phosphate treated coating on the surface of zinc coated steel sheets is formed from needle crystals with a length of several μm, however, in the present invention, it is extremely important that the crystals are formed in a granulated crystal shape.

The shape of the crystals can be easily observed by surface SEM. Specifically, if the surface of a steel sheet (after solvent degreasing if it is an oil coated material) is observed by SEM (at an accelerating voltage of 15 Kv, with no inclination, and at a magnification of 5000×), it is possible to easily distinguish between granulated crystals and needle crystals. In the present invention, it is important that these granulated crystals form the main portion of the crystals. A phosphate treated coating formed principally with granulated crystals is shown in FIG. 2.

In order to make a still more clear-cut distinction, it is possible to make a distinction using the ratio of the major axis of the crystals to the minor axis thereof. If the ratio of the major axis to the minor axis is close to 1.0, this means that the crystals have an approximately granulated shape. Specifically, among the crystals seen when photographed by SEM (at a magnification of 5000×) in an arbitrary visual field, the average ratio is taken over all the crystals by measuring the average value of those crystals whose length ratio of the major axis to the minor axis is closest to 1.00 and those crystals whose length ratio of the major axis to the minor axis is the largest.

For example, FIGS. 3 and 4 show the results when the crystals shown in FIGS. 1 and 2 are traced in a planar view.

In the case of the needle crystals shown in FIG. 1, the ratios of the major axis to the minor axis of all the crystals in the visual field are measured, and those whose length ratio of major axis to minor axis is closest to 1.00 (the FIG. 3*a* portion) and those whose length ratio of major axis to minor axis is the largest (the FIG. 3*b* portion) are selected, and average ratio thereof may be determined.

In the same way, in the case of the granulated crystals shown in FIG. 2, those whose length ratio of major axis to minor axis is closest to 1.00 are set as the FIG. 4*a* portion, and those whose length ratio of major axis to minor axis is the largest are set as the FIG. 4*b* portion.

If this average ratio is 1.00 or greater and 2.90 or less, then, as is shown in FIG. 5, it is clear that formability with beads is excellent. Note that formability with beads is evaluated by the number of times continuous molding is possible during continuous processing and only those that are capable of 10 or more continuous processings are acceptable.

The present inventors examined several methods for changing the shape of the crystals from a needle shape to a granulated shape as described above, and also invented a production method for industrially and stably ensuring granulated crystals.

Zinc phosphate treatment solutions that are normally used contain 0.5 to 5 g/liter of a Zn ion, 5 to 50 g/liter of phosphoric acid ions, 0.5 to 30 g/liter of nitric acid ions, 0.1 to 2.0 g/liter of fluoride ions or complex fluoride ions in fluorine conversion, and where necessary 0.1 to 5 g/liter of Ni ions or the like. Normally, the zinc coated steel sheet is treated by a spray method or by an immersion method with a bath temperature of 40 to 70° C. and a reaction time of 1 to 10 seconds so as to deposit the zinc phosphate based treatment coating. Needless to say, the shape of produced crystals of the coating is a needle shape.

The present inventors added Mg ions to a zinc phosphate treatment solution that uses the above normal treatment solution as a base, and discovered that, if the Mg ions are at least 6 g/l and the Zn ions are at least 0.5 g/l, then stable granulated crystals that are the essential feature of the present invention can be produced.

In this case, it is particularly important that 6 g/l or more of the Mg ions are present. If the amount of Mg ions is less than 6 g/l, granulated crystals are not formed. If the amount of Zn ions is less than 0.5 g/l, the reaction speed is slow and it is difficult for a coating to be formed.

The phosphate treatment solution of the present invention will now be described.

In the phosphate treatment solution used in the present invention, there is no particular limitation as to the concentration of the phosphoric acid ions, the nitric acid ions, and the fluoride ions, however, it is sufficient if the phosphate treatment solution contains 5 to 50 g/L of phosphoric acid ions, at least 0.5 g/l of nitric acid ions, and 0.1 to 2.0 g/L of fluoride ions or complex fluoride ions in fluorine conversion.

In the present invention, as described above, the most important factor is that the Mg ions are at least 6 g/l and the Zn ions are at least 0.5 g/l.

Moreover, there is no particular limitation as to the source of supply of the phosphoric acid ions, the nitric acid ions, the zinc ions, and the magnesium ions, however, orthophosphoric acid, nitric acid, zinc phosphate or zinc nitrate, and magnesium nitrate are used, respectively.

There is neither any particular limitation as to the source of supply of the fluoride ions or complex fluoride ions, however, hydrofluoric acid, hydrofluosilicic acid, hydrofluoboric acid, and the like may be used.

There is neither any particular limitation as to metallic ions other than the coexistent Zn and Mg ions, however, one or more types of metallic ion selected from Fe, Ni, Co, Mn, Ca, Cu, and the like may be included. Essentially, it is desirable that the amount is not greater than 5 g/liter because of the competing reaction when the Mg is incorporated into the Zn.

There is no particular limitation as to the phosphate treatment method according to the present invention, however, it is desirable that a zinc coated steel sheet undergoes a preliminary activation treatment in a treatment solution including titanium colloid. Thereafter, it is desirable that the phosphate treatment solution according to the present invention is coated using either a spray treatment method or an immersion treatment method at a bath temperature of 40 to 70° C. for a treatment time of 1 to 10 seconds.

If the bath temperature is less than 40° C., there is insufficient reactivity and a predetermined coating weight cannot be guaranteed. If the bath temperature is greater than 70° C., the treatment bath easily deteriorates. If the processing time is less than 1 second, it is difficult to form the predetermined coating weight, while longer than 10 seconds is unfavorable in view of the production costs.

Moreover, as a result of yet further investigations, it was determined that even if the amount of Zn ions contained in the phosphate treatment solution is less than 0.5 g/l or is 0 g/l, and if the amount of Mg ions is at least 10 g/and the amount of nitric acid ions is at least 40 g/l, the coating of the present invention can be formed.

Namely, regardless of whether the concentration of Zn ions in the treatment solution is low, or whether there are no Zn ions in the treatment solution, by making the nitric acid ions coexist in a large amount, the Zn dissolution in the plating was accelerated, and it was determined that the phosphate coating could be formed.

As described above, a main characteristic of the present invention is that the structure of the crystals is changed by implementing a phosphate treatment on zinc coated steel sheet using a phosphate treatment solution in which Mg ions are at least 6 g/l and Zn ions are at least 0.5 g/l, or Mg ions are at least 10 g/l and Zn ions are 0 or more and less than 0.5 g/l, and nitric acid ions are at least 40 g/l. However, a further characteristic is that the amount of Mg incorporated into the zinc phosphate coating is increased. As a result of still further earnest research, it was determined that excellent corrosion resistance was achieved by the amount of Mg incorporated into the zinc phosphate coating. Namely, it was determined that if the content of the Mg included in the phosphate coating is 10 mg/m$^2$ or more, then the corrosion resistance is excellent. As an example, when the concentration of Zn ions is 1 g/l and the concentration of Mg ions is 30 g/l, then the amount of Mg in the coating in a zinc phosphate coating amount of 1.6 g/m$^2$ is 60 mg/m$^2$.

Moreover, in order to obtain good spot weldability, it was determined that the coating amount should be controlled to 0.5 to 3.0 g/m$^2$. If the coating amount is less than 0.5 g/m$^2$, the area of direct contact between the zinc coating and the electrodes (Cu—Cr) increases and the continuous dotting performance deteriorates because the Zn and Cu form an alloy. If, however, the amount is greater than 3.0 g/m$^2$, the electrical resistance of the phosphate coating of the present invention itself is too great and the continuous dotting performance deteriorates because surface flash is generated during welding.

The steel sheet according to the present invention has excellent corrosion resistance in this state, however, it is desirable that rust prevention oil be applied for intermediate rust prevention.

Moreover, in order to further improve corrosion resistance, a method was examined in which a heavy magnesium phosphate aqueous solution was coated and dried on the top layer of the zinc phosphate treated coating prepared by the above method. As a result, it was also discovered that, if the amount of coating provided is 0.5 g/m$^2$ or less, the crystals retain a granulated shape and the workability with beads is excellent.

Although the mechanism is unclear, the coated heavy magnesium phosphate is related to the crystal structure of the zinc phosphate treated coating, and it is thought that it grows along the stable surface of the crystal structure of the lower layer thereof. If the amount of coating exceeds 0.5 g/m$^2$, the workability deteriorates because the granulated crystals are not formed, but needle crystals being formed.

In the complex phosphate treated coating according to the present invention, if the total coating amount of the zinc phosphate treated coating and the applied heavy magnesium phosphate is 0.5 to 3.0 g/m$^2$, then good spot weldability can be obtained.

Moreover, it is desirable that the complex steel sheet according to the present invention is coated with a rust prevention oil for intermediate rust prevention.

The present inventors further predicted from the change in the shape of the crystals that there was some change in the structure of the crystals, and examined a method of quantifying this simply using X-ray diffraction. As a result, resulting from their investigation into the relationship between the measurement of the X-ray diffraction pattern and the workability of the drawing in the bead press process, they discovered that, in the X-ray diffraction pattern measurement using CuKα ray characteristic X-rays, there is a strong correlation in the phosphate treated coating between the workability of the drawing in the bead press process and the strength ratio (Ia/Ib) of the maximum strength value (Ia) of the maximum peak when 2θ is not less than 9.540° and not more than 9.800° to the maximum strength value (Ib) of the maximum peak when 2θ is not less than 19.200° and not more than 19.660°, and thus achieved the present invention. Namely, as is indicated by the diagram of the relationship between the drawing performance in the bead press process and the strength ratio (Ia/Ib) shown in FIG. 6, if the phosphate treated coating has a crystal structure in which the strength ratio (Ia/Ib) is not less than 3.0, then there is highly excellent workability in the bead press drawing performance. For reference, the results of an X-ray diffraction pattern measurement for a product according to the present invention using CuKα ray characteristic X-rays are shown in FIG. 7. The strength ratio (Ia/Ib) shown in FIG. 7 is 9.9. Note that in the pattern measurement in FIG. 8, the strength ration (Ia/Ib) was 2.6.

The mechanism behind why the bead press drawing workability changes when the strength ratio changes is not clear, however, it is thought that the symmetry in the original monoclinic crystals worsens when the crystal structure changes so as to form various peaks. It is extremely difficult, industrially, to create single crystals and then specify the crystal structure of each, however, the present invention has a further advantage in that, within the limits of this range, workability is excellent and it is possible to easily determine product performance even if there are a plurality of crystal structures.

BEST EMBODIMENT FOR THIS INVENTION

EXAMPLES

Figure 1:
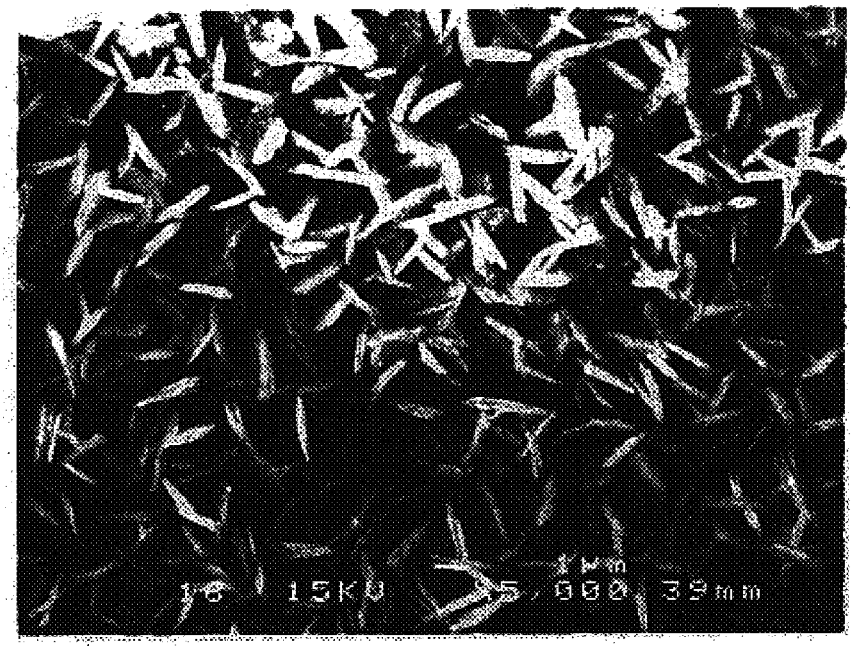
FIG. 1 is an SEM photograph (5000×) of needle crystals of the comparative example.
Figure 2:
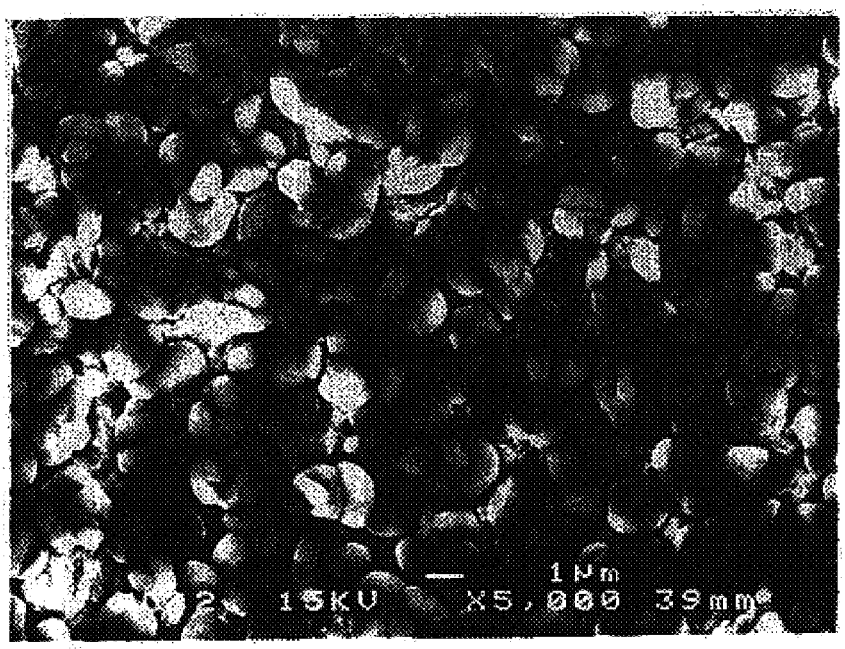
FIG. 2 is an SEM photograph (5000×) of granular crystals of the example.
Figure 3:
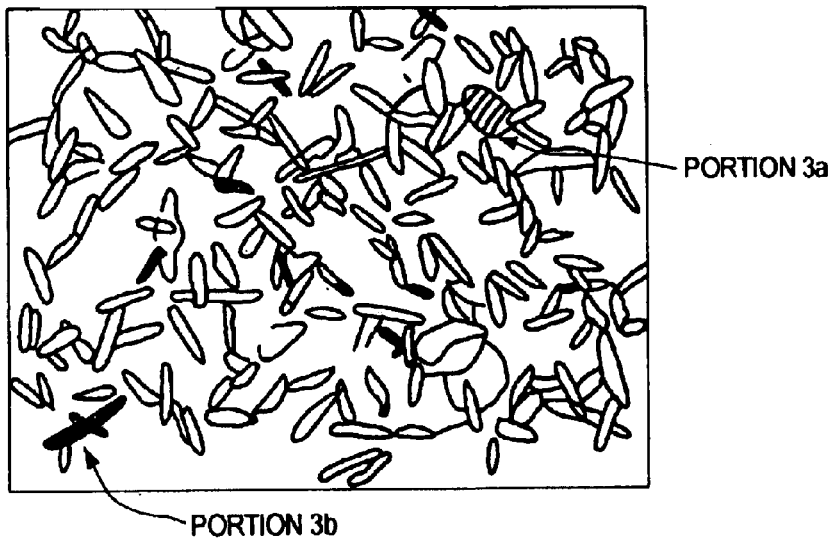
FIG. 3 is a typical view of phosphate crystals projected from the surface of FIG. 1, wherein the portion a, indicated by the diagonal lines, is a crystal whose ratio of major axis to minor axis is closest to 1.00, while the portion b, indicated by the diagonal lines, is a crystal whose ratio of major axis to minor axis is the largest.
Figure 4:
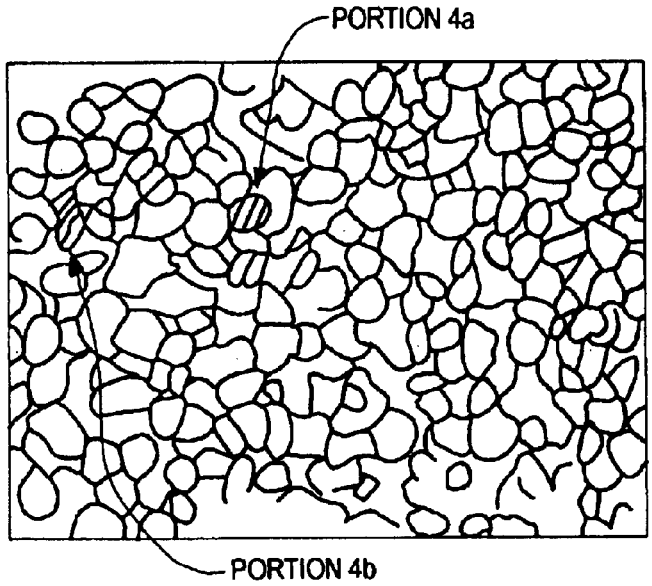
FIG. 4 is a typical view of phosphate crystals projected from the surface of FIG. 2, wherein the portion a, indicated by the diagonal lines, is a crystal whose ratio of major axis to minor axis is closest to 1.00, while the portion b, indicated by the diagonal lines, is a crystal whose ratio of major axis to minor axis is the largest.
Figure 5:
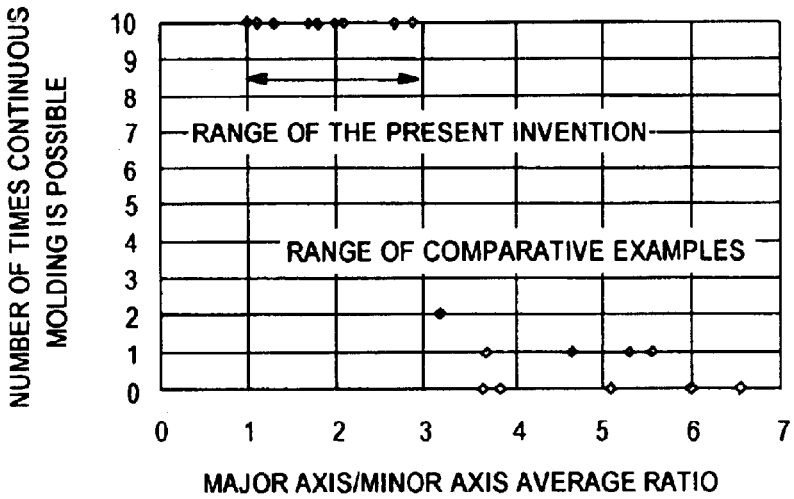
FIG. 5 is a relational diagram showing the relationship between formability with beads and the major axis/minor axis average ratio.
Figure 6:
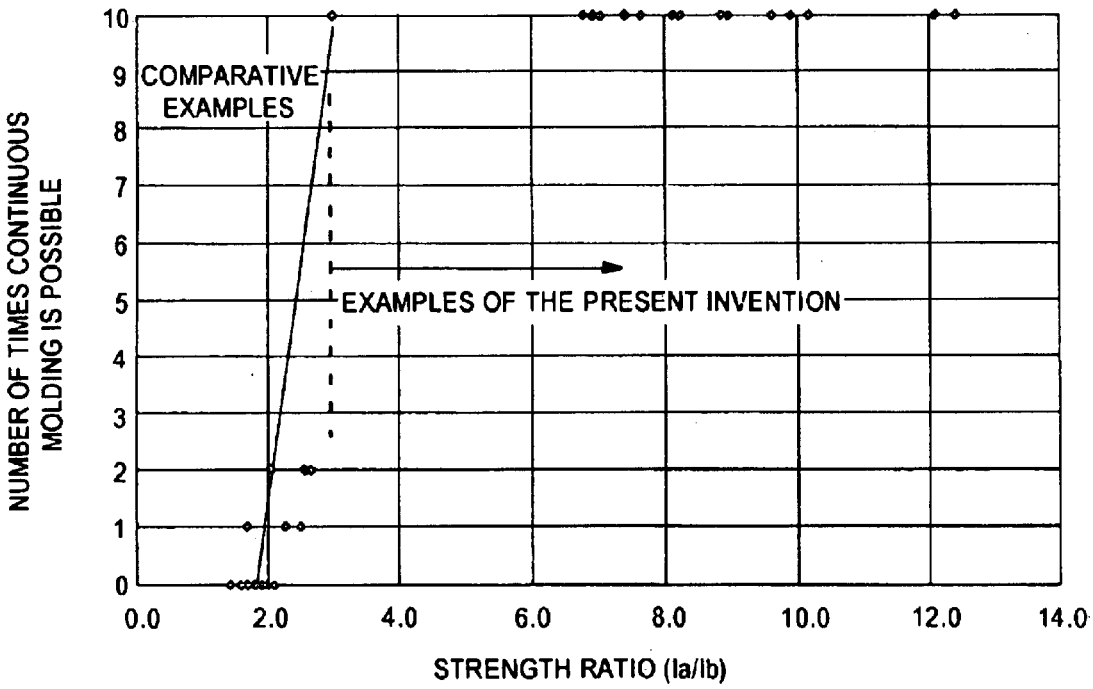
FIG. 6 is a relational diagram showing the relationship between the strength ratio (Ia/Ib) and formability with beads.
Figure 7:
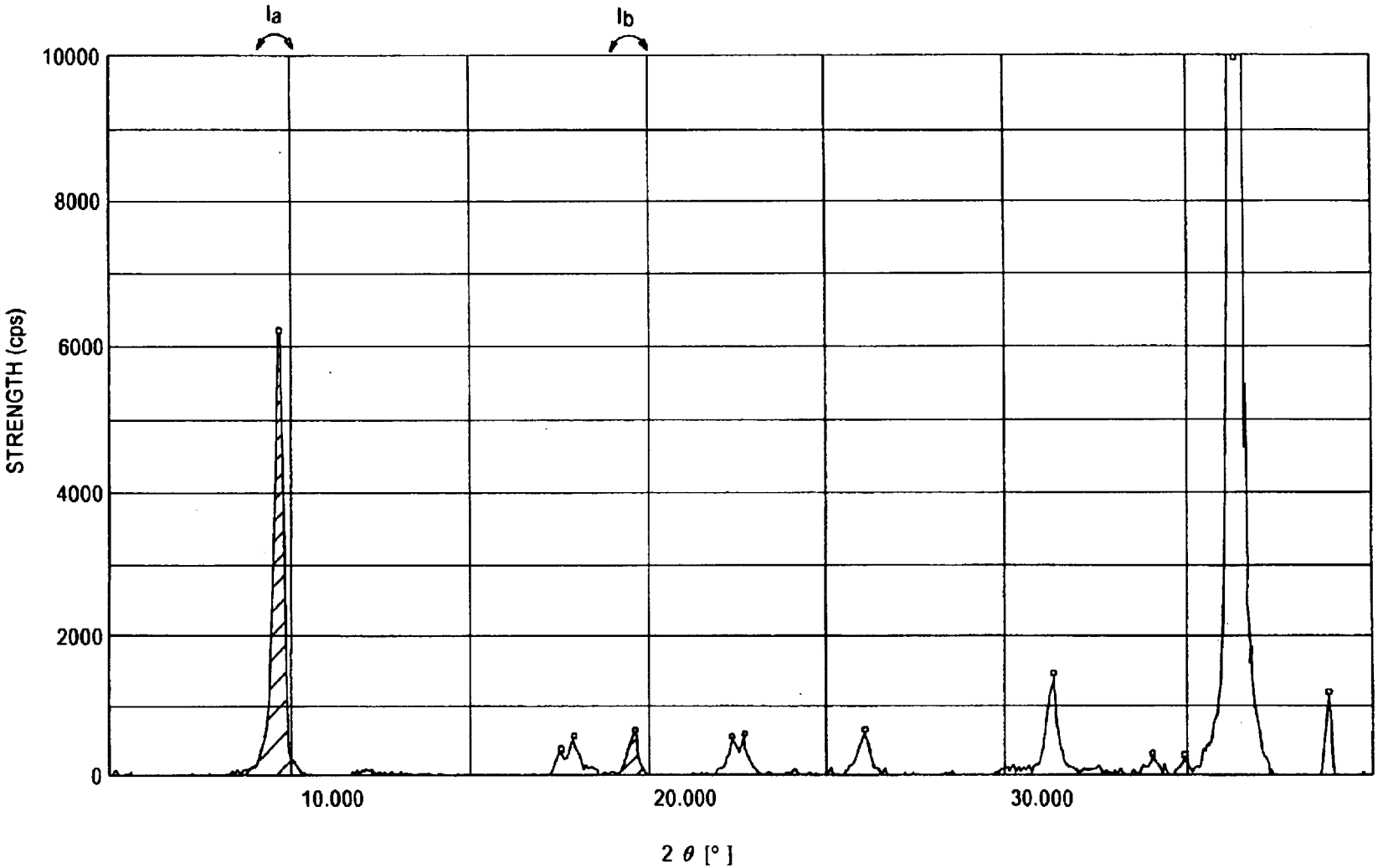
FIG. 7 is an XRD diffraction pattern chart of Example 9.
Figure 8:
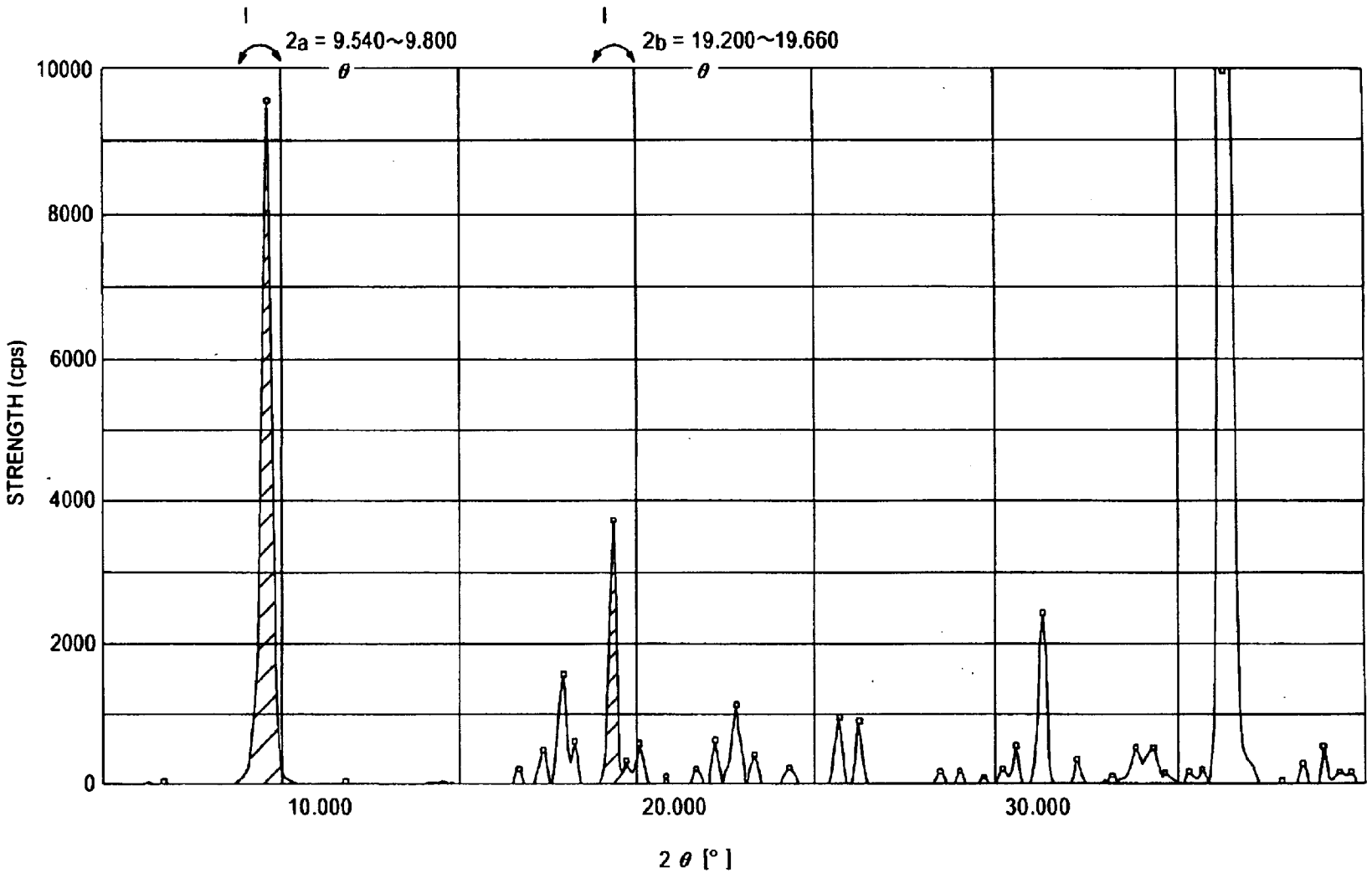
FIG. 8 is an XRD diffraction pattern chart of Comparative example 10.

Examples of the present invention are given below, however, the present invention is not limited by these examples.

1. (Adjustment of Sample Test Material)

Materials; electrically zinc coated steel sheet (30 g per $m^2$ per one side) having a thickness of 0.7 mm and r (Lankford value) of 1.9 was used.

2. (Surface Activation Treatment)

After the material (i.e. the zinc coated steel sheet) was degreased, a commercial titanium colloid based treatment agent (PL-ZN manufactured by Nihon Parkerizing Co., LTD.) was used to perform a preliminary treatment. Various zinc phosphate treatments were then carried out and the material was then washed and dried.

3-1. (Zinc Phosphate Treatment Method 1)

Treatment Solution Base A

Examples 1 to 6 and Comparative Examples 1 to 2

Phosphate treatment bath A (5 g/l of phosphoric acid ions, 1 g/l of Zn ions, 2 g/l of Ni ions, 0.5 g/l of Mg ions, 0.15 g/l of fluorine, and 1 g/l of nitric acid ions) was used as the base treatment solution. The temperature of the treatment bath was set at 60° C. and phosphate treatment was performed by a spray treatment. The material was then washed and dried (Comparative example 1).

Magnesium nitrate in metallic ion amounts of 5.0, 10, and 30 g/l was added to the treatment bath A and the same treatment was performed. Thereafter, the treatment time was changed to form the zinc phosphate coatings with the coating amounts shown in Table 1.

As shown in the table, when the concentration of the Mg ions in the bath is 5.5 (comparative example 2), the crystals are not granulated and the workability is not satisfactory. Here, because the concentration of the Mg ions in the bath, in this case, is the sum of the 5.0 g/l of Mg ions added to the 0.5 g/l of the Mg ions in the base bath, this is 5.5 g/l. When 10 and 30 g/l of Mg ions were added, excellent workability was achieved in all cases (Examples 1 to 6). Moreover, the Examples 2 and 4, in which the amount of Mg in the coating was large, also had good corrosion resistance. When the amount of the coating is small, as in Example 1, the weldability is deteriorated.

Treatment Solution Base B

Examples 7 to 8 and Comparative Example 3

Phosphate treatment bath B (2.5 g/l of phosphoric acid ions, 0.5 g/l of Zn ions, 1 g/l of Ni ions, 0.25 g/l of Mg ions, 0.1 g/l of fluorine, and 1 g/l of nitric acid ions) was used as the base treatment solution. The temperature of the treatment bath was set at 60° C. and phosphate treatment was performed by a spray treatment. The material was then washed and dried (Comparative example 3).

Magnesium nitrate in metallic ion amounts of 10 and 30 g/l was added to the treatment bath B and the same treatment was performed. Thereafter, the treatment time was changed to form the zinc phosphate coatings shown in Table 1 (Examples 7 and 8).

The workability was inferior in Comparative example, but good workability was achieved within the range according to the present invention.

Treatment Solution Base C

Example 9

Phosphate treatment bath C containing no Mg ions (10 g/l of phosphoric acid ions, 2.0 g/l of Zn ions, 5 g/l of Ni ions, 0.2 g/l of fluorine, and 1 g/l of nitric acid ions) was used as the treatment solution. Magnesium nitrate in a metallic ion amount of 30 g/l was added and the temperature of the treatment bath was set at 60° C. Phosphate treatment was then performed by a spray treatment. The material was then washed and dried (Example 9). Good workability was achieved within the range according to the present invention.

Treatment Solution Base D

Example 10

Phosphate treatment bath D containing no Mg ions (20 g/l of phosphoric acid ions, 4.0 g/l of Zn ions, 1 g/l of Ni ions, 0.2 g/l of fluorine, and 1 g/l of nitric acid ions) was used as the treatment solution. Magnesium nitrate in a metallic ion amount of 60 g/l was added and the temperature of the treatment bath was set at 60° C. Phosphate treatment was then performed by a spray treatment. The material was then washed and dried (Example 10). Good workability was achieved within the range according to the present invention.

Treatment Solution Base E

Example 11 and Comparative Examples 4 and 5

Phosphate treatment bath E containing no Mg or Ni ions (10 g/l of phosphoric acid ions, 2.0 g/l of Zn ions, 0.2 g/l of fluorine, and 1 g/l of nitric acid ions) was used as the base treatment solution. The temperature of the treatment bath was set at 60° C. and phosphate treatment was performed by a spray treatment. The material was then washed and dried (Comparative examples 4 and 5).

Magnesium nitrate in a metallic ion amount of 30 g/l was added to the treatment bath E and the same treatment was then performed. Thereafter, a zinc phosphate coating was formed (Example 11). The workability was inferior in Comparative example, but good workability was achieved within the range according to the present invention.

Treatment Solution Base F

Example 12 and Comparative Example 6

Co was added to the above base treatment solution A to prepare the phosphate treatment bath F (5 g/l of phosphoric acid ions, 1.0 g/l of Zn ions, 2 g/l of Ni ions, 0.5 g/l of Mg ions, 2 g/l of Co ions, 0.15 g/l of fluorine, and 1 g/l of nitric acid ions). The temperature of the treatment bath was set at 60° C. and phosphate treatment was performed by a spray treatment. The material was then washed and dried (Comparative example 6).

Magnesium nitrate in a metallic ion amount of 30 g/l was added to the treatment bath F and the same treatment was then performed. Thereafter, a zinc phosphate coating of 1.6 g/m$^2$ was formed. The workability was inferior in Comparative example, but good workability was achieved within the range according to the present invention.

As shown in Table 1, in contrast to the excellent workability obtained with good formability with beads in the examples of the present invention, the comparative examples, which were outside the range of the present invention, showed a remarkable deterioration in workability.

TABLE 1

(Examples)

| | Treatment Bath Conditions | | | Coating Inspection | | | | Evaluation Results | | | |
|---|---|---|---|---|---|---|---|---|---|---|---|
| | Base Bath | Total Ion Conc. (g/l) | | Coating Amount | Mg Amount | Crystal Shape Average | | Claim 1, 2, 9 | Claim 3 Corrosion | Claim 4 | |
| No. | Composition | Zn | Mg | g/m$^2$ | mg/m$^2$ | ratio | Ia/Ib | Workability | resistance | Weldability | Remarks |
| Examples | | | | | | | | | | | |
| 1 | A | 1 | 10.5 | 0.4 | 9 | 2.1 | 6.5 | Pass | Fail | Fail | CL 1, 2, 9 |
| 2 | A | 1 | 10.5 | 1.0 | 22 | 1.5 | 8.0 | Pass | Pass | Pass | CL 1, 2, 3, 4, 9 |
| 3 | A | 1 | 30.5 | 0.2 | 2 | 1.3 | 9.0 | Pass | Fail | Fail | CL 1, 2, 9 |
| 4 | A | 1 | 30.5 | 0.6 | 19 | 1.9 | 7.8 | Pass | Pass | Pass | CL 1, 2, 3, 4, 9 |
| 5 | A | 1 | 30.5 | 1.0 | 38 | 1.9 | 7.4 | Pass | Pass | Pass | CL 1, 2, 3, 4, 9 |
| 6 | A | 1 | 30.5 | 1.6 | 60 | 1.5 | 6.8 | Pass | Pass | Pass | CL 1, 2, 3, 4, 9 |
| 7 | B | 0.5 | 10.25 | 0.5 | 9 | 2.0 | 6.5 | Pass | Fail | Pass | CL 1, 2, 4, 9 |
| 8 | B | 0.5 | 30.25 | 0.3 | 14 | 1.5 | 7.0 | Pass | Pass | Fail | CL 1, 2, 3, 9 |
| 9 | C | 2 | 30.0 | 1.8 | 60 | 1.3 | 9.9 | Pass | Pass | Pass | CL 1, 2, 3, 4, 9 |
| 10 | D | 4 | 60.0 | 1.8 | 54 | 1.2 | 10 | Pass | Pass | Pass | CL 1, 2, 3, 4, 9 |
| 11 | E | 2 | 30.0 | 1.8 | 41 | 2.0 | 6.8 | Pass | Pass | Pass | CL 1, 2, 3, 4, 9 |
| 12 | F | 1 | 30.5 | 1.6 | 60 | 1.5 | 6.8 | Pass | Pass | Pass | CL 1, 2, 3, 4, 9 |
| Comparative Examples | | | | | | | | | | | |
| 1 | A | 1 | 0.5 | 0.8 | 2 | 3.2 | 1.6 | Fail | Fail | Pass | |
| 2 | A | 1 | 5.5 | 1.5 | 12 | 3.2 | 1.8 | Fail | Pass | Pass | |
| 3 | B | 0.5 | 0.25 | 1.5 | 4 | 3.2 | 1.7 | Fail | Fail | Pass | |
| 4 | E | 2 | 0 | 2.5 | 0 | 6.1 | 1.4 | Fail | Fail | Pass | |
| 5 | E | 2 | 0 | 3.5 | 0 | 5.9 | 1.6 | Fail | Fail | Fail | |
| 6 | F | 1 | 0.5 | 1.8 | 2 | 6.1 | 1.7 | Fail | Fail | Pass | |

3-2. (Zinc Phosphate Treatment Method 2)

Treatment Solution Base G

Examples 13 and 14 and Comparative Examples 7 and 8

Phosphate treatment bath G containing no Mg or Zn ions (10 g/l of phosphoric acid ions, 0.2 g/l of fluorine, and 1 g/l of nitric acid ions) was prepared as a base treatment solution.

Zinc nitrate, magnesium nitrate, and nitric acid are added to the treatment bath G in order to adjust the concentrations of Zn ions, Mg ions, and nitric acid ions shown in Table 2. The temperature of the treatment bath was set at 60° C. and phosphate treatment was performed by a spray treatment. The material was then washed and dried. Note that the treatment time in the examples was set at 2 seconds, while the treatment time in the comparative examples was set at 10 seconds.

As in Example 13 and 14, it is possible to form a coating when the solution contains 10 g/l or more of Mg ions and 40 g/l or more of nitric acid ions and each falls within the range of the present invention.

However, in Comparative examples 7 and 8, because there are insufficient Mg ions and nitric acid ions, no coating was formed even with a treatment time of 10 seconds.

TABLE 2

| | Treatment Bath Conditions | | | | Coating Inspection | | | | Evaluation Results | | | |
|---|---|---|---|---|---|---|---|---|---|---|---|---|
| | Base Bath | Ion Conc. (g/l) | | | Coating Amount | Mg Amount | Crystal Shape Average | | Claim 1, 2, 9 | Claim 3 Corrosion | Claim 4 | |
| No. | Composition | Zn | Mg | $NO_3$ | $g/m^2$ | $mg/m^2$ | ratio | Ia/Ib | Workability | resistance | Weldability | Remarks |
| Examples | | | | | | | | | | | | |
| 13 | G | 0 | 10 | 40 | 0.3 | 6 | 2.8 | 7.6 | Pass | Fail | Fail | CL 1, 2, 9 |
| 14 | G | 0.3 | 30 | 153 | 1.6 | 60 | 1.5 | 7.9 | Pass | Pass | Pass | CL 1, 2, 3, 4, 9 |
| Comparative Examples | | | | | | | | | | | | |
| 7 | G | 0 | 4 | 25 | 0 | 0 | Not measurable | Not measurable | Fail | Fail | Fail | |
| 8 | G | 0.3 | 4 | 25 | 0 | 0 | Not measurable | Not measurable | Fail | Fail | Fail | |

3-3. Complex Phosphate Treated Coating Preparation Method

Examples 15 to 18 and Comparative Examples 9 to 11

After the material (i.e. the zinc coated steel sheet) was degreased, a commercial titanium colloid based treatment agent (PL-ZN manufactured by Nihon Parkerizing Co., LTD.) was used to perform a preliminary treatment. Thereafter, using the same method as in Examples 4 and 6, a base material a (coating amount 0.6 $g/m^2$) and a base material b (coating amount 1.6 $g/m^2$) on which zinc phosphate coatings were formed in advance were prepared.

A base material c was also prepared using the same method as in Comparative example 1.

Using the base materials a, b, and c treated with a zinc phosphate coating, a heavy magnesium phosphate aqueous solution (a 50% aqueous solution of heavy Mg phosphate manufactured by Yoneyama Chemical Industries Co., Ltd. diluted by a factor of 5) was further coated using a roll coater and was dried so that the sheet temperature reached 110° C. The number of rotations was controlled such that the weights of the applied coatings were the coating weights shown in Table 3.

As is shown in Table 3, in contrast to the excellent workability obtained with good formability with beads in the examples of the present invention, the comparative examples, which were outside the range of the present invention, showed a remarkable deterioration in workability.

TABLE 3

| | Zinc phosphate treated base material | | | Heavy Mg phosphate coating | Coating Inspection Total coating | Mg | Crystal Shape | | Evaluation Results Claim 1, 2, 9 | Claim 3 Corrosion | Claim 4 | |
|---|---|---|---|---|---|---|---|---|---|---|---|---|
| No. | Symbol | Average ratio | Coating amount | amount $g/m^2$ | amount $mg/m^2$ | amount $mg/m^2$ | Average ratio | Ia/Ib | Workability | resistance | Weldability | Remarks |
| Examples | | | | | | | | | | | | |
| 15 | a | 1.9 | 0.6 | 0.2 | 0.8 | 39 | 2.1 | 7.4 | Pass | Pass | Pass | CL 1, 2, 3, 4, 9 |
| 16 | a | 1.9 | 0.6 | 0.4 | 1.0 | 59 | 2.5 | 6.9 | Pass | Pass | Pass | CL 1, 2, 3, 4, 9 |
| 17 | a | 1.9 | 0.6 | 0.5 | 1.1 | 69 | 2.9 | 6.8 | Pass | Pass | Pass | CL 1, 2, 3, 4, 9 |
| 18 | b | 1.5 | 1.6 | 0.2 | 1.8 | 60 | 1.9 | 6.9 | Pass | Pass | Pass | CL 1, 2, 3, 4, 9 |
| Comparative Examples | | | | | | | | | | | | |
| 9 | a | 1.9 | 0.6 | 0.7 | 1.3 | 79 | 3.2 | 2.9 | Fail | Pass | Pass | |
| 10 | b | 1.5 | 1.6 | 1.5 | 3.1 | 200 | 4.5 | 2.6 | Fail | Pass | Fail | |
| 11 | c | 3.2 | 0.8 | 0.4 | 1.2 | 47 | 3.4 | 2.0 | Fail | Pass | Pass | |

4. Evaluation Method

① Measurement of Average Ratio of Major Axis to Minor Axis.

After each of the materials was degreased with solvent (n-hexane), the average ratio was measured by photographing arbitrary locations on the surface of the steel sheets (at an accelerated voltage of 15 KV and a magnification of 5000×) by SEM (JSM-6400, manufactured by JEOL Ltd.).

Using the photographs thus obtained, those crystals having a ratio of major axis to minor axis closest to 1.00 and those crystals whose ratio of major axis to minor axis was the largest were measured from all those crystals within the field of vision for which a determination as to the crystal grain interface was possible.

Lastly, the average ratio was taken from the average of the crystals whose ratio of major axis to minor axis was closest to 1.00 and the crystals whose ratio of major axis to minor axis was the largest.

② Measurement of the Ia/Ib Strength Ratio.

After each of the materials was degreased with solvent (n-hexane), a 40 mm round piece was measured using an XRD (X-ray diffractor) (RINT-1500 manufactured by Rigaku Denki K.K.) under the following conditions.

XRD Measurement Conditions target: Cu (Kα) tube voltage: 40 KV tube current: 200 mA measured surface: 5 mm×12 mm range of measurement scan angle: 5 to 40° divergence slit: 1° light receiving slit: 0.6 mm scan step: 0.02° scan speed: 4°/min counter: scintillation counter surface normal line: perpendicular to surface of the material plate the largest strength value of the maximum peak (Ia) (cps units) at which 2θ=not less than 9.540° and not more than 9.800° and the largest strength value of the maximum peak (Ib) (cps units) at which 2θ=not less than 19.200° and not more than 19.660° were obtained from the measured peaks.

Lastly, the strength ratio (Ia/Ib) was determined.

③ U Bead Bending Workability

After a sample piece was sheared to a size of 30 mm×300 mm, it was immersed in detergent oil (RL55, manufactured by Idemitsu Industries Co., Ltd.) and was roll drawn. A continuous U bead bending process was then performed. A 60 ton crank press was used for the processing. The processing conditions were BHF=1 ton, processing height=40 mm, bead portion punch R=5 mm, bead portion die R=1 mm, punch R=5 mm, and processing speed=25 spm. Evaluation was made by evaluating the number of times continuous molding was possible, and success was judged by whether or not 10 times was possible without crack formation.

④ Corrosion Resistance

After a sample piece was sheared to a size of 150 mm×70 mm, the edge of the cut surface was sealed, and a bare corrosion resistance examination was performed using a corrosion cycle tester (*the conditions therefor will be described later). Evaluation was performed by measuring the ratio of the surface area where rust occurred after 5 cycles using an image analyzer. Success was judged by whether or not the ratio of the surface area where rust occurred was less than 1% after 5 cycles.

*Corrosion Cycle Test Conditions

One cycle comprising:

salt water spray (6 hours) → drying (3 hours)→wetting (14 hours)→drying (1 hour), was repeated, at respective test condition;

5% NaCl, 35° C.→50° C., 45% RH→50° C., 95% RH→50° C., 45% RH.

⑤ Weldability

After a sample piece was sheared to a size of 100 mm×300 mm, it was coated with rust prevention oil (Noxrust 530F60, manufactured by Parker Industries Co., LTD.), and was then measured under the following conditions (*described later) using an ND 70-24, manufactured by Dengen Ltd. A preliminary measurement was made of the value of the scattering generation current, and, from the scattering generation current value, at a current value of not more than 0.3 KA, the composite continuous dotting performance was examined. Success was judged by a nugget diameter of not less than 3.6 mm after 500 dottings.

Spot welding conditions electrode: CF type (Cu—Cr) electrode with a tip diameter of 5 mm water volume: 3 L/min Applied pressure: 200 kgf sequence: Sq. Time 60 cyc, Up Slope 1 cyc, Weld Time 13 cyc, Ho. Time 2 cyc composite continuous dotting method:

tester (25 dots)→10 seconds interval→cold drawn steel sheet (25 dots)→10 seconds interval repeated for 500 dottings.

⑥ Analysis of Coating Amount and Amount of Mg in Coating

1) The amount of zinc phosphate treated coating was measured using the following method.

Firstly, using a precision balance, the weight of a test piece was measured and the test piece was then dissolved in 5% chromic acid at a room temperature for 5 minutes. It was then washed with water, dried, and the weight of the test piece was measured. The amount of the coating ($g/m^2$) was taken as the difference in weight before and after the dissolution divided by the dissolved surface area.

Next, using the chromic acid solution used in the coating weight measurement, the amount of adhered Mg per unit area in the phosphoric acid coating was measured by ICP (inductive coupling plasma light emission method).

2) The total amount of complex phosphate treated coating was measured using the following method.

Firstly, the weight of a test piece, having a zinc phosphate treated coating formed thereon in advance, was measured. Heavy magnesium phosphate was then coated thereon and dried and the weight of the test piece was measured. The amount of the increase was taken as the heavy magnesium phosphate coating amount.

Next, in order to measure the total complex phosphate coating amount, the weight of the test piece is measured and the test piece was then dissolved for 5 minutes at a room temperature in 5% chromic acid. The test piece was then washed, dried, and the weight of the test piece was measured. The amount of the coating ($g/m^2$) was taken as the difference in weight before and after the dissolution divided by the dissolved surface area.

Next, using the chromic acid solution used in the coating weight measurement, the amount of adhered Mg per unit area in the complex phosphate coating was measured by ICP (inductive coupling plasma light emission method).

INDUSTRIAL APPLICABILITY

According to the present invention, it is possible to obtain a phosphate treated zinc coated steel sheet having excellent workability not achieved in the prior art. The steel sheet of the present invention is simple to produce and cost effective and can be preferably applied for various uses, such as in vehicles, household appliances, building materials, and the like.

What is claimed is:

1. A phosphate treated zinc coated steel sheet with excellent workability, having a phosphate treated coating comprising mainly granulated crystals on a surface of a zinc coated steel sheet.

2. A phosphate treated zinc coated steel sheet with excellent workability, having a phosphate treated coating on a surface of a zinc coated steel sheet in which an average ratio of a major axis to a minor axis of crystals in the phosphate treated coating is not less than 1.00 and not more than 2.90, wherein, the average ratio is an average value of that crystal whose length ratio of the major axis to the minor axis is closest to 1.00 and that crystal whose length ratio of the major axis to the minor axis is the largest from among crystals seen when an SEM photograph (at a magnification of 5000×) is taken.

3. The phosphate treated zinc coated steel sheet according to claim 1 also with excellent corrosion resistance, wherein Mg is contained in the phosphate treated coating in an amount of not less than 10 $mg/m^2$.

4. The phosphate treated zinc coated steel sheet according to claim 1 also with excellent weldability, wherein an adhered amount of the phosphate treated coating is from 0.5 $g/m^2$ to 3.0 $g/m^2$.

5. The phosphate treated zinc coated steel sheet according to claim 1 also with excellent intermediate rust prevention property, wherein a rust prevention oil layer is provided on the phosphate treated coating.

6. A method for producing a phosphate treated zinc coated steel sheet with excellent workability and corrosion resistance, wherein a phosphate treatment is performed on a zinc coated steel sheet using a phosphate treatment solution in which, among metallic ions included in the phosphate treatment solution, an amount of Mg ions is at least 6 g/l and an amount of Zn ions is at least 0.5 g/l.

7. A method for producing a phosphate treated zinc coated steel sheet with excellent workability and corrosion resistance, wherein a phosphate treatment is performed on a zinc coated steel sheet using a phosphate treatment solution in which, among metallic ions included in the phosphate treatment solution, an amount of Mg ions is at least 10 g/l and an amount of Zn ions is 0 or more and less than 0.5 g/l, and an amount of nitric acid ions included in the phosphate treatment solution is at least 40 g/l.

8. A method for producing a phosphate treated zinc coated steel sheet with excellent workability and corrosion resistance, wherein, after the phosphate treatment according to claim 6, a heavy magnesium phosphate coating is formed on a surface thereof by coating and drying in a coating amount of not more than 0.5 $g/m^2$.

9. A phosphate treated zinc coated steel sheet with excellent workability, having a phosphate treated coating on a surface of the zinc coated steel sheet, the phosphate treated coating being characterized in that when measuring an X-ray diffraction pattern using CuKα ray characteristic X-rays, the strength ratio (Ia/Ib) of the largest strength value of the maximum peak (Ia) at which 2θ=not less than 9.540° and not more than 9.800° and the largest strength value of the maximum peak (Ib) at which 2θ=not less than 19.200° and not more than 19.660° is not less than 3.0.

10. The phosphate treated zinc coated steel sheet according to claim 2 also with excellent corrosion resistance, wherein Mg is contained in the phosphate treated coating in an amount of not less than 10 $mg/m^2$.

11. The phosphate treated zinc coated steel sheet according to claim 2 also with excellent weldability, wherein an adhered amount of the phosphate treated coating is from 0.5 $g/m^2$ to 3.0 $g/m^2$.

12. The phosphate treated zinc coated steel sheet according to claim 3 also with excellent weldability, wherein an adhered amount of the phosphate treated coating is from 0.5 $g/m^2$ to 3.0 $g/m^2$.

13. The phosphate treated zinc coated steel sheet according to claim 2 also with excellent intermediate rust prevention property, wherein a rust prevention oil layer is provided on the phosphate treated coating.

14. The phosphate treated zinc coated steel sheet according to claim 3 also with excellent intermediate rust prevention property, wherein a rust prevention oil layer is provided on the phosphate treated coating.

15. The phosphate treated zinc coated steel sheet according to claim 4 also with excellent intermediate rust prevention property, wherein a rust prevention oil layer is provided on the phosphate treated coating.

16. A method for producing a phosphate treated zinc coated steel sheet with excellent workability and corrosion resistance, wherein, after the phosphate treatment according to claim 7, a heavy magnesium phosphate coating is formed on a surface thereof by coating and drying in a coating amount of not more than 0.5 $g/m^2$.

* * * * *